US010267090B2

(12) United States Patent
Savage et al.

(10) Patent No.: US 10,267,090 B2
(45) Date of Patent: Apr. 23, 2019

(54) DRILLING ASSEMBLY HAVING A TILTED OR OFFSET DRIVESHAFT

(71) Applicant: Halliburton Energy Services, Inc., Houston, TX (US)

(72) Inventors: John Keith Savage, Edmonton (CA); Stephen Jones, Cypress, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/513,413

(22) PCT Filed: Dec. 29, 2014

(86) PCT No.: PCT/US2014/072516
§ 371 (c)(1),
(2) Date: Mar. 22, 2017

(87) PCT Pub. No.: WO2016/108817
PCT Pub. Date: Jul. 7, 2016

(65) Prior Publication Data
US 2017/0247947 A1 Aug. 31, 2017

(51) Int. Cl.
*E21B 7/06* (2006.01)
*E21B 4/02* (2006.01)
(Continued)

(52) U.S. Cl.
CPC ..... *E21B 4/02* (2013.01); *E21B 7/067* (2013.01); *E21B 7/068* (2013.01); *E21B 17/00* (2013.01); *E21B 47/02* (2013.01)

(58) Field of Classification Search
CPC ..... E21B 7/068; E21B 7/067
See application file for complete search history.

(56) References Cited

U.S. PATENT DOCUMENTS 4,492,276 A * 1/1985 Kamp ..... E21B 7/068 175/107
5,099,931 A * 3/1992 Krueger ..... E21B 7/068 175/107
(Continued)

FOREIGN PATENT DOCUMENTS

WO 2014022765 A1 2/2014
WO 2014144256 A1 9/2014

OTHER PUBLICATIONS

International Search Report and Written Opinion issued in corresponding application No. PCT/US2014/072516 dated Aug. 31, 2015, 15 pgs.

*Primary Examiner* — Giovanna C. Wright
(74) *Attorney, Agent, or Firm* — Chamberlain Hrdlicka

(57) ABSTRACT

A drilling assembly includes a straight housing in which a mud motor assembly is mounted. The mud motor includes a rotor that rotates within a stator. The rotor has an axial centerline substantially parallel with the housing. A drivetrain is coupled between the rotor and a driveshaft. The driveshaft is coupled to a drill head. The driveshaft has a centerline that is non-coincident with (i.e., offset or angled) the axial centerline. The angle between the driveshaft centerline and the axial centerline may be fixed or variable. The angle may be variable in response to an axial force, imparted to the rotor, that is transferred to the driveshaft through the drivetrain. Additional apparatus, systems, and methods are disclosed.

19 Claims, 5 Drawing Sheets

(51) Int. Cl.
*E21B 17/00* (2006.01)
*E21B 47/02* (2006.01)

(56) References Cited

U.S. PATENT DOCUMENTS

| | | | | |
|---|---|---|---|---|
| 6,216,802 | B1 * | 4/2001 | Sawyer | E21B 7/067 175/61 |
| 2004/0238221 | A1 * | 12/2004 | Runia | E21B 7/067 175/61 |
| 2013/0240268 | A1 | 9/2013 | Crowley et al. | |
| 2013/0319764 | A1 * | 12/2013 | Schaaf | E21B 7/06 175/24 |
| 2014/0182941 | A1 | 7/2014 | Oppelaar | |
| 2014/0209389 | A1 * | 7/2014 | Sugiura | E21B 7/067 175/73 |
| 2014/0251695 | A1 * | 9/2014 | Marchand | E21B 4/02 175/74 |

* cited by examiner

DRILLING ASSEMBLY HAVING A TILTED OR OFFSET DRIVESHAFT

BACKGROUND

Market requirements are driving the need for a mud motor design that may build high doglegs yet also be rotated rapidly from the surface in order to maximize a rate of geological formation penetration such that boreholes may be drilled to a target depth in as short a time as possible. Such an assembly should also be reliable as well as be able to efficiently drill vertical, high dog leg severity curves and lateral sections in one run.

Present drillstrings typically use short bit-to-bend motors. However, these motors have limitations on maximum surface string revolutions per minute (RPM). These string RPM limitations may have a negative impact on rate of penetration (ROP) performance, especially in a lateral section.

Present drillstrings may also use an external bent housing. However, mud motors with an external bent housing may have endurance problems in the threads and upsets between a bearing pack and a power section. Bend limits for speed are traded against each other in order to maintain some semblance of fatigue management based on historical failure experience.

In short, there are general needs for a mud motor configuration that provides high surface rotation speed in vertical and tangent/lateral directions while providing improved fatigue life expectations.

DETAILED DESCRIPTION

Figure 1:
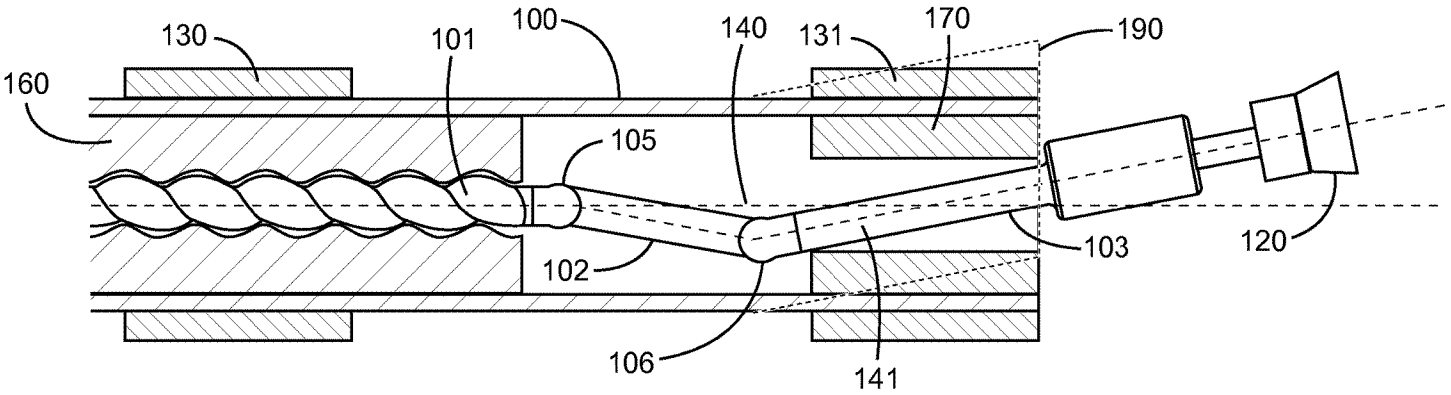
FIG. 1 is a cross-sectional diagram showing an embodiment of a drilling assembly having an internally tilted driveshaft in a straight housing.

FIG. 1 is a cross-sectional diagram showing an embodiment of a drilling assembly having an internally tilted driveshaft in a housing 100. The housing 100 may include tilted (i.e., angled) driveshafts, in accordance with the embodiments of FIGS. 1-3, to reduce or eliminate drillstring RPM limitations of bent housings as well as provide improved fatigue life expectations.

The embodiment of FIG. 1 shows a substantially straight housing 100 that includes a fixed external upper stabilizer 130 and a fixed external bearing housing stabilizer 131. In another embodiment, the housing may include an external bend on the outside of the housing as illustrated as optional housing 190.

During a drilling operation, the stabilizers 130, 131 mechanically stabilize the housing 100 in order to avoid unintentional sidetracking, vibrations, and improve the quality of the borehole being drilled. The stabilizers 130, 131 also control the rotary tendency of the bottom hole assembly (BHA). The stabilizers 130, 131 may help to maintain a particular borehole angle or change the drilling angle by controlling the location of the contact point between the borehole and the collars. The stabilizers 130, 131 may comprise a hollow cylindrical body and stabilizing blades, both made of high-strength steel. The blades may be either straight or spiraled and may be hardfaced for wear resistance.

Figure 4:
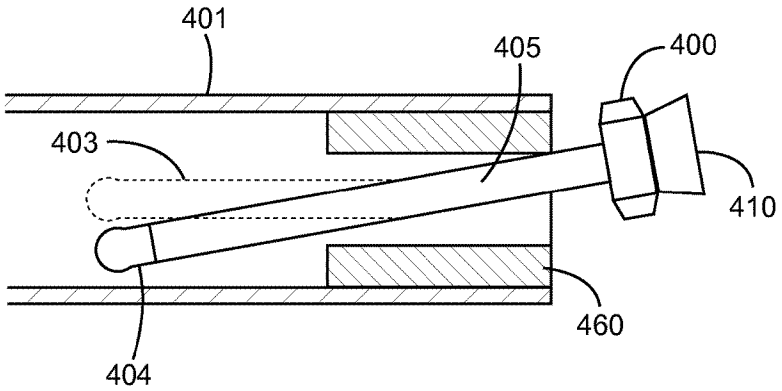
FIG. 4 is a cross-sectional diagram showing an embodiment of a rotating near-bit stabilizer of a drilling assembly.

The embodiment of FIG. 1 shows two stabilizers are coupled to the housing 100. These include the stabilizer 131 just above a drill head (i.e., bearing housing stabilizer) and the stabilizer 130 on an upper portion of the housing 100 (i.e., upper stabilizer). Other embodiments may include different quantities of stabilizers 130, 131 and/or rotating near-bit stabilizers as illustrated in the embodiment of FIG. 4 and discussed subsequently.

The drillstring includes a "mud motor" assembly formed from a rotor 101 and a stator 160. The stator 160 may also be part of the housing 100. The motor uses the Moineau principle to rotate the drillstring as a result of the pumping of a fluid (e.g., drilling mud) through the mud motor (i.e., rotor/stator assembly).

The rotor 101 is coupled to a drivetrain 102 that transfers the rotation of the rotor 101 to a driveshaft 103. A drivetrain 102, as used herein, may include a constant velocity (CV) transmission and one or more CV joints 105, 106. The drivetrain may further be defined as a torsion rod, a geared coupling, or any other way to transmit torque. While FIG. 1 shows two such CV joints 105, 106, other embodiments may use different quantities of joints. The drivetrain may provide the ability to transmit power through variable angles, at a substantially constant rotational speed (i.e., constant velocity), without an appreciable increase in friction.

The driveshaft 103 couples the drill head 120 to the drivetrain 102. The driveshaft 103 may ride on an internal bearing 170 that provides an internal surface upon which the drill string may make contact in order to protect the drill string. The drill head 120 may include a drill bit for drilling through a geological formation.

FIG. 1 illustrates a centerline 141 of the driveshaft 103 that is at an angle with respect to an axial centerline 140 of the mud motor assembly 101, 160. The motor axial centerline 140 may be substantially parallel with the housing at a substantially fixed distance or a selectable distance. The tilt on the driveshaft 103 may be accomplished by the angling of one or more of the CV joints 105, 106 of the drivetrain 102. The tilt on the driveshaft 103 allows for directional control while sliding.

Figure 2:
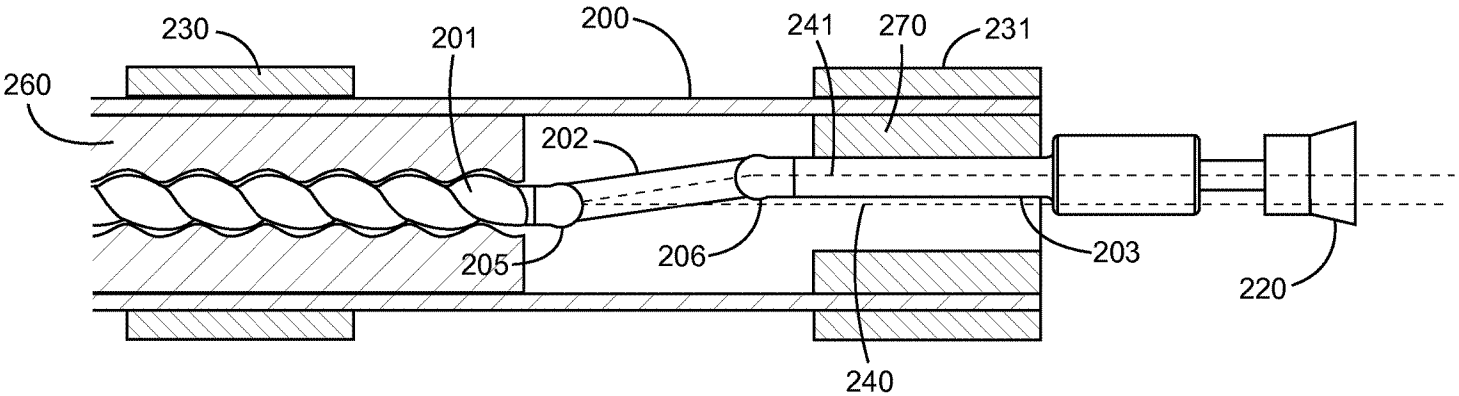
FIG. 2 is a cross-sectional diagram showing an embodiment of a drilling assembly having an internally offset driveshaft in a straight housing.

FIG. 2 is a cross-sectional diagram showing an embodiment of a drilling assembly having an internally offset driveshaft in a straight housing 200. The straight housing 200 may include the offset driveshaft, in accordance with the embodiments of FIGS. 1-3, to reduce or eliminate drillstring RPM limitations of bent housings, as well as to provide improved fatigue life expectations.

The embodiment of FIG. 2 comprises the straight housing 200 with an external upper stabilizer 230 and a bearing housing stabilizer 231. During a drilling operation, the stabilizers 230, 231 mechanically stabilize the housing 200 in order to avoid unintentional sidetracking, vibrations, and improve the quality of the borehole being drilled. The stabilizers 230, 231 may help to maintain a particular borehole angle or to change the drilling angle by controlling the location of the contact point between the borehole and the collars. The stabilizers 230, 231 may comprise a hollow cylindrical body and stabilizing blades, both made of high-strength steel. The blades may be either straight or spiraled and may be hardfaced for wear resistance. The embodiment of FIG. 2 shows two stabilizers coupled to the housing 200. These include the stabilizer 231 just above a drill head (bearing housing stabilizer) and the stabilizer 230 on an upper portion of the housing 200 (i.e., upper stabilizer). Other embodiments may include different quantities of stabilizers 230, 231 and/or rotating near-bit stabilizers as illustrated in the embodiment of FIG. 4 and discussed subsequently.

The drillstring includes a mud motor assembly that includes the rotor 201 that rotates within the stator 260. The stator 260 may be part of the housing 200.

The rotor 201 is coupled to the drivetrain 202 that transfers the rotation of the rotor 201 to the driveshaft 203. The drivetrain 202 may include one or more CV joints 205, 206. While FIG. 2 shows two such CV joints 205, 206, other embodiments may use different quantities of joints. The CV joints provide the ability to transmit power through variable angles, at a substantially constant rotational speed (i.e., constant velocity), without an appreciable increase in friction.

The driveshaft 203 couples the drill head 220 to the drivetrain 202. The driveshaft 203 may ride on an internal bearing 270 of the housing 200 that provides an internal surface upon which the drill string may make contact in order to protect the drill string and the housing from damage. The drill head 220 may include the drill bit for drilling through a geological formation.

FIG. 2 illustrates a centerline 241 of the driveshaft 203 that is offset with respect to the centerline 240 of the motor assembly 201, 260. It can be seen that the offset centerline 241 is parallel with, but offset a distance from, the straight, axial centerline 240 that is substantially parallel with the housing. The offset may be accomplished by the angling of both of the CV joints 205, 206 of the drivetrain 202.

The driveshafts of the embodiments of FIGS. 1 and 2 both have centerlines that are non-coincident with the axial centerline of the motor. The non-coincident centerlines may be fixed at a predetermined tilt angle or offset distance. This may be accomplished by the CV joints being fixed at predetermined angles. In another embodiment, the tilt angle or offset distance may be dynamically variable during the drilling operation. This may be accomplished by CV joints that are movable through a range of angles. One embodiment for changing the tilt angle or offset distance is illustrated in FIG. 3.

Figure 3:
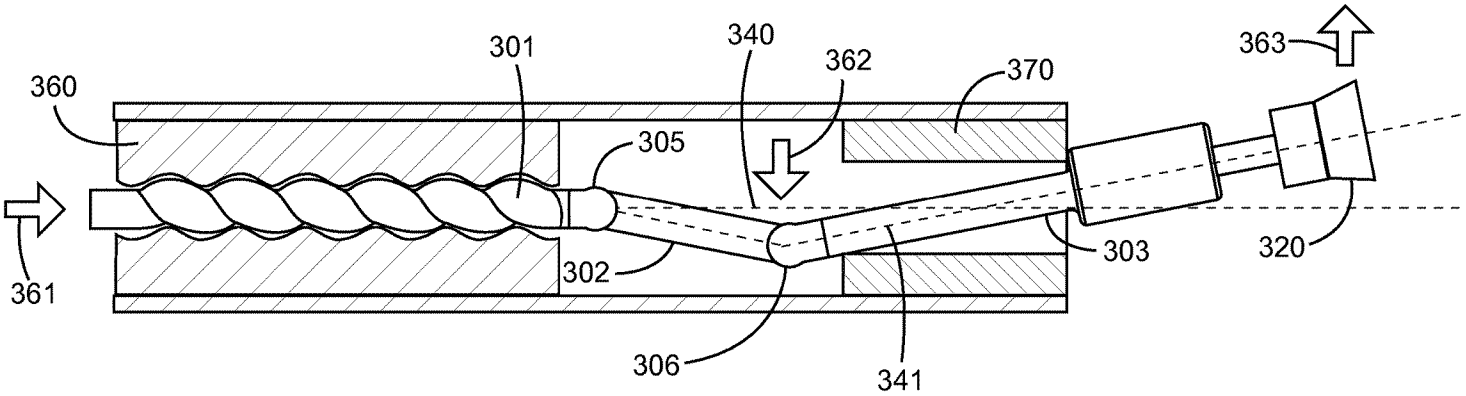
FIG. 3 is a cross-sectional diagram showing an embodiment for pressure tilting the internally offset driveshaft of a drilling assembly in accordance with the embodiments of FIGS. 1 and 2.

FIG. 3 is a cross-sectional diagram showing an embodiment for pressure tilting the driveshaft of a drilling assembly in accordance with the embodiments of FIGS. 1 and 2. This embodiment provides a dynamically adjustable tilt of the driveshaft with respect to the straight, axial centerline 340.

As in the previously described embodiments, the embodiment of FIG. 3 includes a rotor section 301 to drive the drillstring. A plurality of CV joints 305, 306 couple the CV drive train section 302 between the rotor section 301 and the driveshaft 303. The driveshaft 303 is coupled to the drill head 320 that may include the drill bit for the drillstring.

As in the embodiment of FIG. 1, the centerline of the driveshaft 341 is tilted with respect to the axial centerline 340 of the motor assembly 301, 360. This is the result of the side force imparted onto the up hole end of the driveshaft through the drivetrain 302 from the rotor 301. Axial pressure 361 acting on the cross section of the rotor 301 creates an axial force in the rotor 301 such that it is being pushed out of the bottom of the stator 360. This axial load is transferred through the drivetrain assembly 302, 305, 306 to the driveshaft 303 and reacted in the bearing pack thrust bearings (not shown for purposes of clarity). The drivetrain 302 is capable of transmitting torque and thrust loads but cannot carry moment loads. Given the end load to the rotor, the drivetrain 302 will move into a stable position when side loads 362, 363 are brought into balance. In this embodiment, this occurs when the driveshaft 303 rests against bearing stop 370 or when the side load 362 imparted onto the down hole driveshaft end balances the system. In an embodiment, the angles between the transmission components may be kept relatively small in order to reduce wear in the CV moving interfaces.

FIG. 4 is a cross-sectional diagram showing an embodiment of a rotating near-bit stabilizer. Instead of being coupled to the external surface of the housing 401 and stationary, as in the embodiments of FIGS. 1 and 2, the rotating near-bit stabilizer 400 is coupled to the drill head 410 and rotates with the drill head.

The rotating near-bit stabilizer embodiment may include a driveshaft 405 in either a tilted orientation 404, having an angle relative to the rotor centerline or an offset orientation 403 that is parallel to the rotor centerline. These concepts were illustrated previously with reference to FIGS. 1 and 2, respectively.

The embodiment of FIG. 4 may provide stabilization in a drilling operation to perform directionally in slide and rotary modes for relatively high severity dog leg applications. In order to achieve a desired amount of tilt from the driveshaft inside the bearing housing 401, the driveshaft length may be reduced from the other embodiments and radial and thrust bearings 460 used in the housing 401. The radial and thrust bearings 460 may comprise diamond in order to get adequate tilt angle for high dog leg severity applications.

Figure 5:
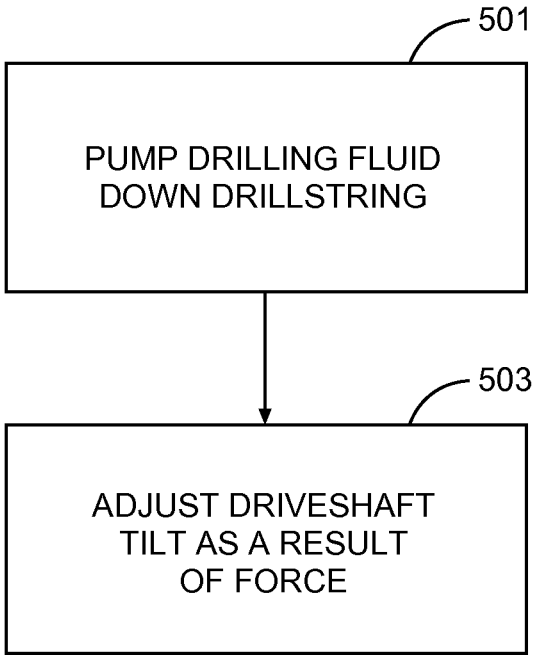
FIG. 5 is a flowchart showing an embodiment of a method for operation of a pressure tilted driveshaft of a drilling assembly.

FIG. 5 is a flowchart showing an embodiment of a method for operation of a pressure tilted driveshaft in a drilling assembly. In block 501, the method includes pumping drilling fluid (e.g., drilling mud) down the drill string. For example, mud pump 832 of FIG. 8 may be used to pump the drilling fluid.

The resistance to the flow of the fluid across the positive displacement mud motor causes a pressure differential across the mud motor. An axial force is applied to the rotor that is equal to the pressure differential times the rotor cross-sectional area. This force drives the rotor out of the stator towards the down hole side of the motor. The force is passed through the drivetrain to the driveshaft. In block 503, the driveshaft tilt may be adjusted as a result of the force.

In block 503, a fluid (e.g., drilling mud) is injected into the housing to cause the mud motor (i.e., rotor/stator assembly) to rotate. The drivetrain transmits this rotation to the now angled driveshaft in order to rotate the drill bit for drilling through the formation. A change in the mud flow may change the axially aligned force and, thus, the angle of the driveshaft.

Other embodiments may have the thrust load from the rotor pass into a dedicated mechanism (e.g., piston) in the same area as either the drivetrain (see FIG. 6) or the mud motor inlet (see FIG. 7) that may exaggerate the axial force, thus increasing the side load available for the same thrust from the rotor. The piston may comprise a solid disk or a disk having slots or vanes to allow more fluid to pass and having a greater diameter than the rotor. These embodiments are illustrated in FIGS. 6 and 7.

Figure 6:
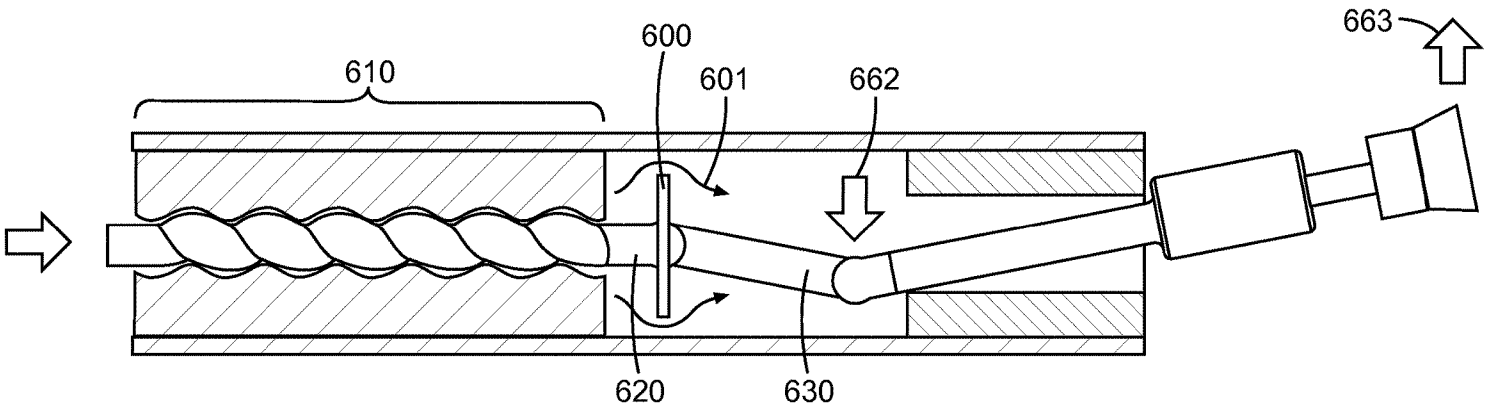
FIG. 6 is a cross-sectional diagram showing an embodiment of a drilling assembly having a piston.

FIG. 6 is a cross-sectional diagram showing an embodiment of a drilling assembly having a piston 600. The piston 600 may be attached to the rotor 620 near the drivetrain 630. The flow of fluid 601 from the mud motor 610 hits the piston 600, thus exaggerating the axial force and increasing the side loads 662, 663.

Figure 7:
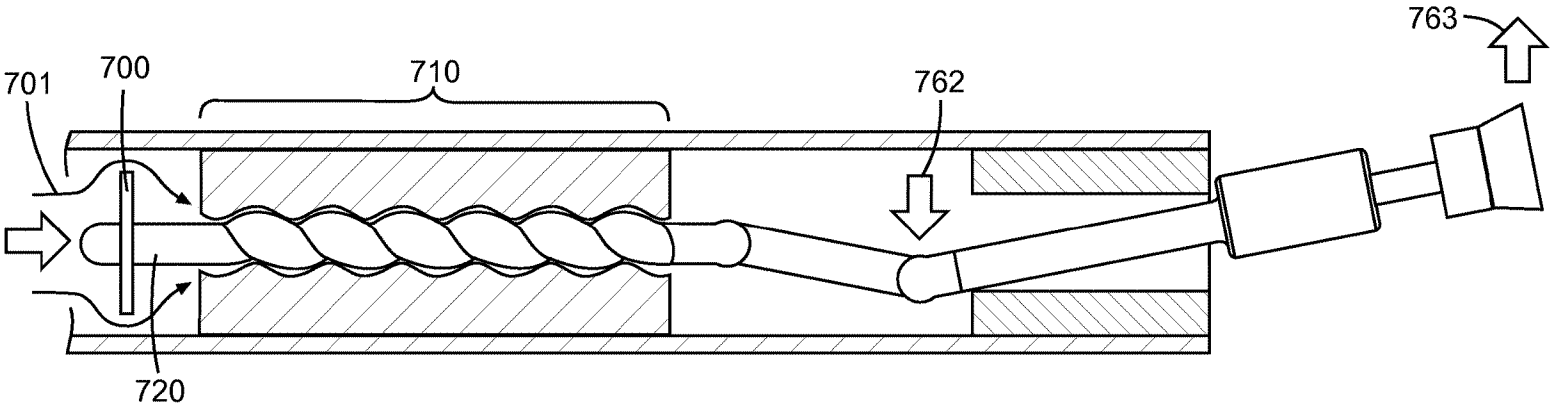
FIG. 7 is a cross-sectional diagram showing another embodiment of a drilling assembly having a piston.

FIG. 7 is a cross-sectional diagram showing another embodiment of a drilling assembly having a piston 700. The piston 700 may be attached to the rotor 720 at the inlet to the mud motor 710. The flow of fluid 701 into the mud motor inlet hits the piston 700, thus exaggerating the axial force and increasing the side loads 762, 763.

Figure 8:
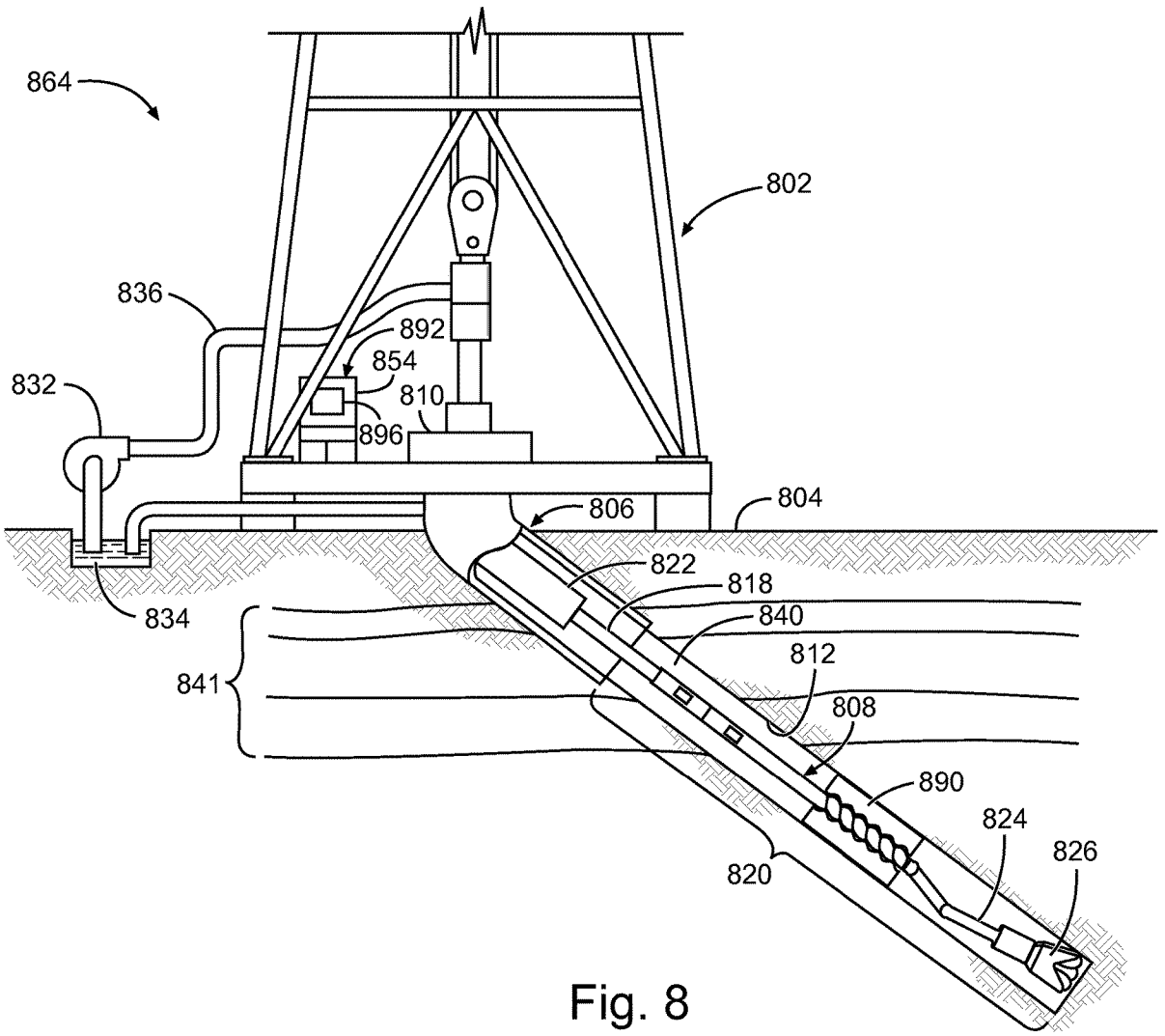
FIG. 8 is a diagram showing a drilling system that may incorporate the embodiments of FIGS. 1-7.

FIG. 8 is a diagram showing a drilling system 864 that may incorporate the embodiments of FIGS. 1-7. System 864 includes a drilling rig 802 located at the surface 804 of a well 806. The drilling rig 802 may provide support for a drillstring 808. The drillstring 808 may operate to penetrate the rotary table 810 for drilling the borehole 812 through the subsurface formations 841. The drillstring 808 may include a drill pipe 818 and a bottom hole assembly 820, perhaps located at the lower portion of the drill pipe 818.

The bottom hole assembly 820 may include a down hole tool housing 824 that incorporates the tilted or offset driveshaft of the above-described embodiments and a drill head 826. The drill head 826 may operate to create the borehole 812 by penetrating the surface 804 and the subsurface formations 841.

During drilling operations, the drillstring 808 (perhaps including the drill pipe 818 and the bottom hole assembly 820) may be rotated by the mud motor 890, located down hole, as described previously. Drill collars 822 may be used to add weight to the drill head 826. The drill collars 822 may also operate to stiffen the bottom hole assembly 820, allowing the bottom hole assembly 820 to transfer the added weight to the drill head 826, and in turn, to assist the drill head 826 in penetrating the surface 804 and subsurface formations 814.

During drilling operations, a mud pump 832 may pump drilling fluid (sometimes known by those of ordinary skill in the art as "drilling mud") from a mud pit 834 through a hose 836 into the drill pipe 818, through the mud motor 890, and down to the drill bit 826. The drilling fluid can flow out from the drill head 826 and be returned to the surface 804 through an annular area 840 between the drill pipe 818 and the sides of the borehole 812. The drilling fluid may then be returned to the mud pit 834, where such fluid is filtered. In some embodiments, the drilling fluid can be used to cool the drill head 826, as well as to provide lubrication for the drill head 826 during drilling operations. Additionally, the drilling fluid may be used to remove subsurface formation cuttings created by operating the drill head 826.

The workstation 854 and the controller 896 may include modules comprising hardware circuitry, a processor, and/or memory circuits that may store software program modules and objects, and/or firmware, and combinations thereof. The workstation 854 and controller 896 may be configured into a control system 892 to control the direction and depth of the drilling in response to formation characteristics. In an embodiment, the direction of drilling may be changed by executing the method illustrated in FIG. 5 to adjust the angle of tilt of the driveshaft.

While the above-described embodiments of FIGS. 1-4 are shown separately, other embodiments may combine these embodiments. For example, in such a combined embodiment, the near-bit stabilizer 400 of FIG. 4 may be combined with the embodiment of FIG. 1. Other such combinations may also be realized.

Example 1 is drilling assembly, comprising: a motor assembly coupled to a housing and having an axial centerline substantially parallel with the housing; a drivetrain coupled to the motor assembly; and a driveshaft coupled between the drivetrain and a drill head, the driveshaft having a centerline fixed in a non-coincident orientation with the axial centerline.

In Example 2, the subject matter of Example 1 can optionally include wherein the housing comprises an external bend.

In Example 3, the subject matter of Examples 1-2 can optionally include wherein the motor assembly comprises a rotor configured to rotate within a stator.

In Example 4, the subject matter of Examples 1-3 can optionally include wherein the driveshaft centerline is at an angle with the axial centerline.

In Example 5, the subject matter of Examples 1-4 can optionally include wherein the driveshaft centerline is parallel to and offset by a substantially fixed distance or selectable distance from the axial centerline.

In Example 6, the subject matter of Examples 1-5 can optionally include wherein the drivetrain comprises a constant velocity (CV) transmission with one or more CV joints, a torsion rod, or a geared coupling.

In Example 7, the subject matter of Examples 1-6 can optionally include wherein the drivetrain comprises a plurality of CV joints, including a first CV joint coupling the drivetrain to the motor assembly and a second CV joint coupling the drivetrain to the driveshaft.

In Example 8, the subject matter of Examples 1-7 can optionally include wherein the plurality of CV joints are fixed at predetermined angles with respect to the axial centerline.

In Example 9, the subject matter of Examples 1-8 can optionally include a near-bit stabilizer coupled to the driveshaft such that the stabilizer rotates with the drill head.

In Example 10, the subject matter of Examples 1-9 can optionally include wherein the drivetrain is configured to change the non-coincident orientation of the driveshaft centerline in response to a change in an axially aligned force.

In Example 11, the subject matter of Examples 1-10 can optionally include wherein the driveshaft centerline is tilted by an angle with respect to the axial centerline wherein the angle varies in response to the change in the axially aligned force.

In Example 12, the subject matter of Examples 1-11 can optionally include wherein the rotor is configured to transfer the axially aligned force to the driveshaft through the drivetrain.

In Example 13, the subject matter of Examples 1-12 can optionally include wherein the drivetrain is configured to move into a stable position when side loads are brought into balance in response to side loads on the drilling assembly being balanced.

Example 14 is a drilling system comprising: a downhole tool comprising: a substantially straight housing; a motor assembly coupled to the housing and having an axial centerline substantially parallel with the housing, the motor assembly comprising a rotor and a stator; a driveshaft coupled to the rotor, the driveshaft having a centerline at an angle with the axial centerline, wherein the angle is variable in response to an axial force applied to the rotor; and a drill head coupled to the driveshaft.

In Example 15, the subject matter of Example 14 can optionally include a stabilizer coupled to the drill head.

In Example 16, the subject matter of Examples 14-15 can optionally include wherein the stabilizer is configured to rotate with the drill head.

In Example 17, the subject matter of Examples 14-16 can optionally include a first stabilizer coupled to an upper portion of the housing and a second stabilizer coupled to a lower portion of the housing.

In Example 18, the subject matter of Examples 14-17 can optionally include a piston coupled to the rotor at an output of the motor assembly.

In Example 19, the subject matter of Examples 14-18 can optionally include a piston coupled to the rotor at an output of the motor assembly.

Example 20 is method for drilling comprising: pumping drilling fluid down a drillstring; and adjusting a tilt of a driveshaft of the drillstring as a result of an axial force of the drilling fluid on a mud motor assembly.

In Example 21, the subject matter of Example 20 can optionally include wherein the tilt is an offset from a centerline of the mud motor assembly.

Although specific embodiments have been illustrated and described herein, it will be appreciated by those of ordinary skill in the art that any arrangement that is calculated to achieve the same purpose may be substituted for the specific embodiments shown. Various embodiments use permutations and/or combinations of embodiments described herein. It is to be understood that the above description is intended to be illustrative, and not restrictive, and that the phraseology or terminology employed herein is for the purpose of description. Combinations of the above embodiments and other embodiments will be apparent to those of skill in the art upon studying the above description.

What is claimed is:

1. A drilling assembly, comprising:

a motor assembly coupled to a substantially straight housing and having an axial centerline substantially parallel with the housing;

a drivetrain coupled to the motor assembly;

a drill head; and a driveshaft located within and extending from the substantially straight housing and coupled between the drivetrain and the drill head, the driveshaft having a centerline fixed in a non-coincident orientation with the axial centerline, and wherein the driveshaft centerline is parallel to and offset by a substantially fixed distance or selectable distance from the axial centerline.

2. The drilling assembly of claim 1, wherein the motor assembly comprises a rotor configured to rotate within a stator.

3. The drilling assembly of claim 1, wherein the driveshaft centerline is at an angle with the axial centerline.

4. The drilling assembly of claim 1, wherein the drivetrain comprises a constant velocity (CV) transmission with one or more CV joints, a torsion rod, or a geared coupling.

5. The drilling assembly of claim 4, wherein the drivetrain comprises a plurality of CV joints, including a first CV joint coupling the drivetrain to the motor assembly and a second CV joint coupling the drivetrain to the driveshaft.

6. The drilling assembly of claim 5, wherein the plurality of CV joints are fixed at predetermined angles with respect to the axial centerline.

7. The drilling assembly of claim 1, further comprising a near-bit stabilizer coupled to the driveshaft such that the stabilizer rotates with the drill head.

8. The drilling assembly of claim 1, wherein the drivetrain is configured to change the non-coincident orientation of the driveshaft centerline in response to a change in an axially aligned force.

9. The drilling assembly of claim 8, wherein the driveshaft centerline is tilted by an angle with respect to the axial centerline wherein the angle varies in response to the change in the axially aligned force.

10. The drilling assembly of claim 8, wherein the rotor is configured to transfer the axially aligned force to the driveshaft through the drivetrain.

11. The drilling assembly of claim 10, wherein the drivetrain is configured to move into a stable position when side loads are brought into balance in response to side loads on the drilling assembly being balanced.

12. A drilling system comprising:

a downhole tool comprising:

a substantially straight housing;

a motor assembly coupled to the housing and having an axial centerline substantially parallel with the housing, the motor assembly comprising a rotor and a stator;

a driveshaft coupled to the rotor and located within and extending from the substantially straight housing, the driveshaft having a centerline at an angle with the axial centerline, wherein the angle is variable in response to an axial force applied to the rotor;

a drill head coupled to the driveshaft; and a piston coupled to the rotor at an output of the motor assembly.

13. The system of claim 12, further comprising a stabilizer coupled to the drill head.

14. The system of claim 13, wherein the stabilizer is configured to rotate with the drill head.

15. The system of claim 12, further comprising a first stabilizer coupled to an upper portion of the housing and a second stabilizer coupled to a lower portion of the housing.

16. A method for drilling comprising:

pumping drilling fluid down a drillstring; and adjusting a tilt of a driveshaft of the drillstring as a result of an axial force of the drilling fluid on a mud motor assembly, wherein the tilt is an offset from a centerline of the mud motor assembly.

17. The method of claim 16, wherein adjusting the tilt is based at least in part on a change in a mud flow.

18. The method of claim 16, comprising increasing the axial force via a piston.

19. The method of claim 18, wherein the piston comprises slots, vanes, or a combination thereof.

* * * * *